United States Patent [19]

Ohe et al.

[11] Patent Number: 4,679,052

[45] Date of Patent: Jul. 7, 1987

[54] AUTOMOBILE ANTENNA DEVICE

[75] Inventors: Junzo Ohe; Hiroshi Kondo, both of Aichi, Japan

[73] Assignee: Toyota Jidosha Kabushiki Kaisha, Toyota, Japan

[21] Appl. No.: 801,771

[22] Filed: Nov. 26, 1985

[30] Foreign Application Priority Data

Nov. 27, 1984 [JP] Japan ..... 59-251244

[51] Int. Cl.[4] ..... H01Q 1/32

[52] U.S. Cl. ..... 343/712; 343/842; 343/866

[58] Field of Search ..... 343/711, 712, 713, 788, 343/789, 842, 866, 867

[56] References Cited

U.S. PATENT DOCUMENTS

| | | | |
|---|---|---|---|
| 3,495,264 | 2/1970 | Spears | 343/842 |
| 3,872,455 | 3/1975 | Fuller et al. | 343/842 |
| 4,605,899 | 8/1986 | Eumurian et al. | 343/842 |

FOREIGN PATENT DOCUMENTS

| | | | |
|---|---|---|---|
| 226579 | 4/1943 | Switzerland | 343/842 |

*Primary Examiner*—Robert E. Wise

*Attorney, Agent, or Firm*—Cushman, Darby & Cushman

[57] ABSTRACT

An automobile antenna device in which broadcasted waves received by the automobile body is efficiently detected so that the various kinds of receivers equipped with the automobile can be supplied the detected signal. This device comprises an electrostatic shield case which is formed an opening thereat to face to a metal plate of the automobile body and a loop antenna being internally arranged in the electrostatic shield case so that the loop antenna can be facingly provided to the opening in its close vicinity. The loop antenna is equipped with a plurality of loops which are respectively formed by wound antenna wires, and the respective loops are sectorially arranged with the side of the electrostatic shield opening side as their centers.

Therefore, the surface current being induced by the broadcasted waves and flowing in the metal plate of the automobile body can be efficiently detected, and there is no need of pole antenna and others externally exposed, and further, the automobile antenna device can be easily obtained with small sizes and high accuracy.

7 Claims, 7 Drawing Figures

AUTOMOBILE ANTENNA DEVICE

BACKGROUND OF THE INVENTION

1. Field of the Invention

The present invention relates to an automobile antenna device, and more particularly to an improved automobile antenna device in which broadcasted waves received by the automobile body is efficiently detected so that the various kinds of receivers equipped with the automobile can be supplied the detected signal.

2. Description of the Prior Art

In order to receive the various kinds of broadcasted waves, that is, the broadcasted communicating waves of radio, television, telephone, etc., with high accuracy, the automobile requires to equip an antenna device, and it is also important to install the antenna device for transmission and reception of citizen's band wave between the automobile and the other station. It has been understood that the antenna device takes an important role among communicating functions which will be standardly equipped with the automobile in the future.

A pole antenna is well known for the general automobile antenna device in the prior art, and the antenna projected from the automobile body is of preferable capability in its receiving characteristics.

In the practical use, however, the pole antenna mentioned above has problems of damage by snap, bend, or the like, mischief and theft, cause of wind noise, etc. and it has been requested to solve such kind of problems somehow.

Specifically, in the recent years, the frequency band of broadcasted waves or the communicating waves to be received in the automobile is widened, and there requires many antennas to be installed in accordance with the respective frequency bands. Furthermore, the appearance of the automobile is ruined by such many antennas, and the mutual electric interference among the many antennas lowers their receiving capability.

SUMMARY OF THE INVENTION

Accordingly, it is an object of the present invention to provide an automobile antenna device with high efficiency in small sizes without using a pole antenna which must be externally exposed out of the automobile body.

In keeping with the principles of the present invention, the object is accomplished with the automobile antenna device which is provided a loop antenna in an electrostatic shield case having an opening to face to a metal plate of the automobile body so that the loop antenna can face to the opening in its close vicinity.

In the present invention, the loop antenna has a plurality of loops formed by wound antenna line, and the respective loops are sectorially arranged with one side portions thereof are concentrated in the vicinity of the opening and the other side portions thereof are separately disposed in an approximately same distance.

As evident from the composition as is mentioned above, the automobile antenna device in accordance with the teachings of the present invention picks up, through the loop antenna provided in the electrostatic shield case, the magnetic field of surface current which is formed in the metal plate of the automobile body by the broadcasted waves.

In the present invention, as the loop antenna is formed with a plurality of loops and the output voltage of the loop antenna equals to the multiplication of the number of loop windings, the resonance can be strengthened so much that the disturbance from the adjacent broadcasting stations can be easily deleted to increase the receptive separation rate, which contributes to an increase of receiving sensitivity.

As the respective loops are sectorially arranged with one side portions thereof are concentrated in the vicinity of the opening of the electrostatic shield case and the other side portions thereof are separately disposed in an approximately same distance, the incidental capacity is generated extremely low among the respective loops. Furthermore, as either one of the loops is arranged with an angle at which the surface current can be detected most efficiently from the metal plate of the automobile, there will be no problem of low sensitivity derived from the incorrect installation of the automobile antenna device at a wrong angle, and receiving action of the broadcasted waves can be preferably performed.

DETAILED DESCRIPTION OF THE INVENTION

Figure 3:
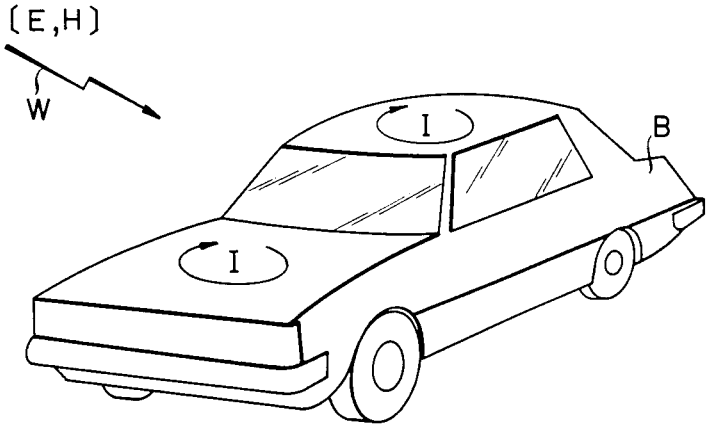
FIG. 3 is an illustration describing surface current I generated in the automobile body B by a foreign high frequency W.

FIG. 3 shows that surface current I is induced in the various parts of an automobile body, specifically in their margin portions, in accordance with the strength of electromagnetic wave, when a foreign electric wave W, such as broadcasted waves, etc., passes through the automobile body B consisting of metal conductor.

Figure 4:
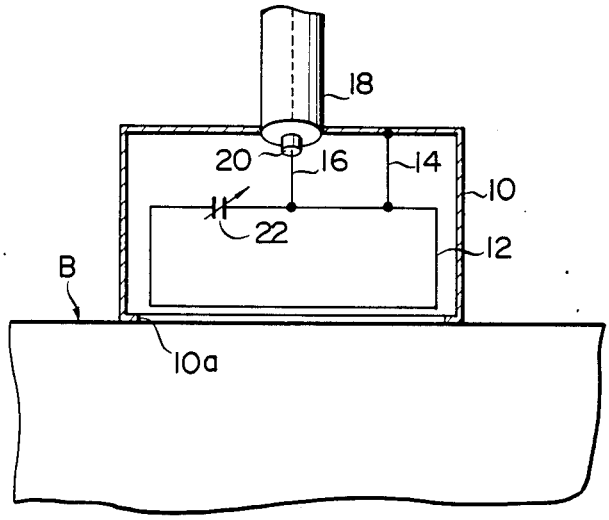
FIG. 4 is an illustration describing the principle of the automobile antenna device in accordance with the teachings of the present invention.

The inventors tried to pick up the surface current induced in the body by such broadcasted waves through the automobile antenna device as is illustrated in FIG. 4.

In the automobile antenna device shown in FIG. 4, a loop antenna 12 is internally fixed in an electrostatic shield case 10 made of a conductor which is used to avoid the mixture of unnecessary foreign waves. A part of this loop antenna 12 is exposed to the outside through an opening 10*a* which is provided in a part of the case 10 mentioned above, and this exposed portion is placed in the close vicinity of the surface of the body B so that the magnetic flux produced by the surface current can be easily picked up by the loop antenna 12.

Another part of the loop antenna 12 is connected to the case 10 by a wire 14, and the output end 16 is connected to a center wire 20 of a coaxial cable 18. A capacitor 22 is also provided to another part of the loop antenna 12 in order to increase the pick-up efficiency of the antenna by resonance of the frequency of the loop antenna 12 to the requested receiving frequency.

According to the automobile antenna device in accordance with the embodiment shown in FIG. 4, therefore, the magnetic flux formed by the high frequency surface current which is induced by the broadcasted waves is firmly caught by the loop antenna 12, and the shield case 10 firmly shielding the foreign waves enables sensitive detection of the surface current only induced in the automobile body by the broadcasted waves.

The detected signal obtained in such a way is taken outside through the coaxial cable 18 and supplied to the various kinds of receivers by way of voltage amplifiers, not illustrated.

Figure 5:
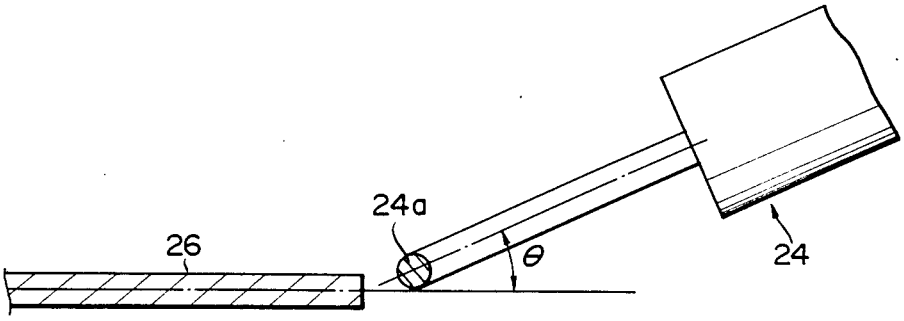
FIG. 5 is an illustration describing the experiment in which dependable relation between the relative angle of the loop area of the loop antenna to the metal plate of the automobile body and the detective efficiency of the surface current in the body.

Right here, the inventors ihvented that the detective efficiency differs remarkably depending on an angle between a loop area formed by the loop antenna 12 and a metal plate surface of the automobile body B which the loop antenna 12 faces to, and performed an experiment shown in FIG. 5 in order to find out the best angle of the loop antenna 12 to the body B.

In the same figure, considering that the loop antenna of the automobile antenna device is installed to face to the metal plate margin of the body, a pick-up end 24a of a pick-up probe 24, which is composed in the same manner with the loop antenna 12 shown in FIG. 4, is closely face to the end of a metal plate 26.

In this state, the angle made between the loop area of the pick-up probe 24 and the extended center line of the metal plate 26 is changed gradually to investigate the dependable relation between the angle e and the detective efficiency of the surface current flowing thrOugh the metal plate 26 by the pick-up probe 24.

Figure 6:
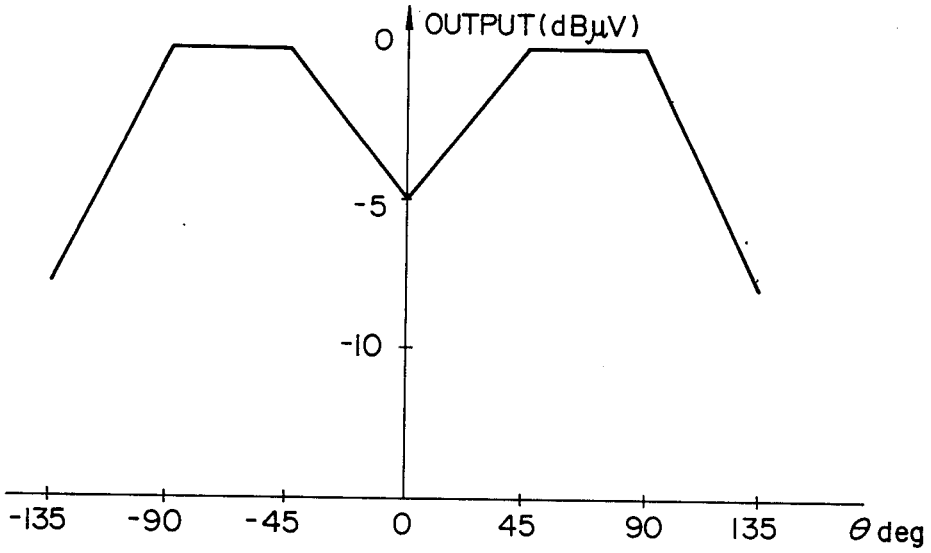
FIG. 6 is an illustration showing the measured outcome from the experiment in FIG. 5.

The measured result of this investigation shows in FIG. 6. As evident from this figure, it is understood that the detective efficiency of the surface current becomes remarkably preferable by 45 through 90 degrees or −45 through −90 degrees in the angle s made between the loop area of the pick-up probe 24 and the extended center line of the metal plate 26, and that the detective efficiency lowers in any other angles.

Accordingly, as shown in FIG. 6, the loop antenna 12 detects the surface current of the automobile body with high efficiency by means of arranging its loop area in the angle of 45 through 90 degrees or −45 through −90 degrees to the extended center line of the metal plate of the body.

Figure 7:
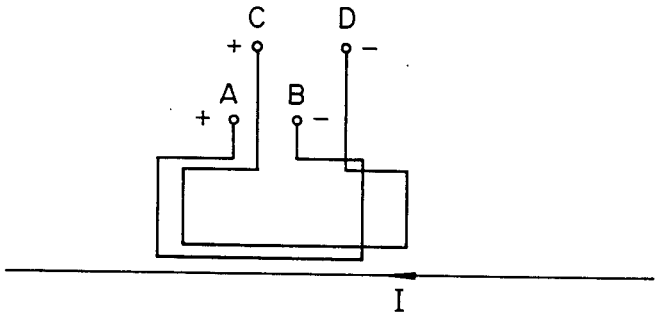
FIG. 7 is an illustration describing the dependable relation between the numbers of the loops of the loop antenna and the detective efficiency of the surface electric current.

The surface current induced in the automobile body by the broadcasted waves is comparatively weak. In order to increase the output voltage from the loop antenna, the numbers of winding times of the antenna wire is increased in most cases. In other words, as shown in FIG. 7, it is evident that, when the loop of A-B and the loop of C-D are closely arranged to face an electric wire which the electric current I flows through, connection of C and D provides the output voltage between A and D by twice higher than the one of A-B or C-D.

However, when the antenna wire is simply wound around densely, incidental capacity arises between the respective loops to cause in movement of the resonant frequency, and the acuteness (Q) and the sensitivity decrease.

The automobile antenna device in accordance with the teachings of the present invention is based on the above mentioned knowledge and view points, and its embodiment will be hereinafter described in accordance with FIGS. 1 and 2.

Figure 1:
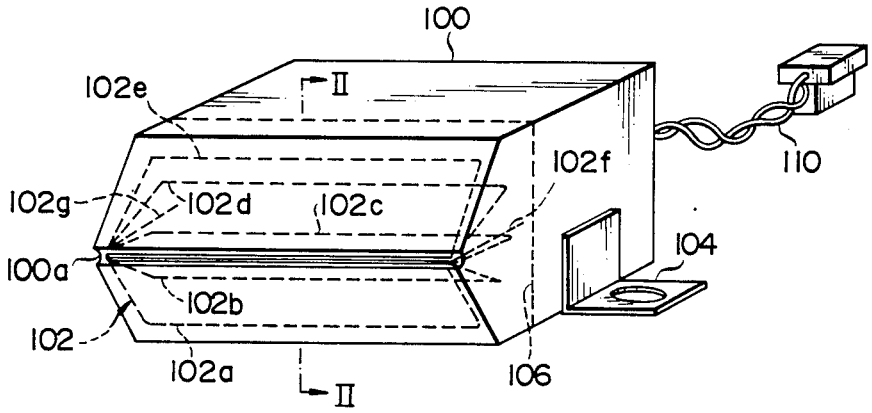
FIG. 1 is a perspective illustration of outer look of an automobile antenna device in accordance with an embodiment of the present invention.
Figure 2:
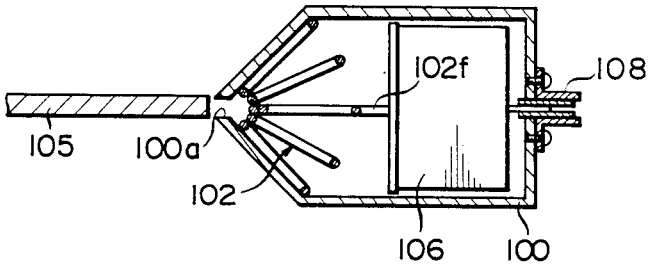
FIG. 2 is a vertical sectional view of the automobile antenna device in accordance with the embodiment of the present invention.

FIG. 1 is a perspective illustration of outer look of the automobile antenna device in accordance with one embodiment of the present invention, and FIG. 2 is a sectional view taken on a line II—II of FIG. 1.

The automobile antenna device in FIG. 1 includes the loop antenna 102 which is internally fixed in the electrostatic shield case 100.

The case 100 has an opening 100*a* to expose a longitudinal side portions of a plurality of loops of the loop antenna 102. The side portions of the loop antenna 102 exposed out of the shield case 100 made of a conductive material can be closely arranged to face to a metal plate of the automobile body, roof rim bar for example. It is preferable that the automobile antenna device is attached to the automobile body by the attachments 104 fixed to the electrostatic shield case 100 by bolts and nuts, spot welding or the like.

The embodiment is characterized in that the loop antenna 102 is composed of five loops formed by means of winding the antenna wire, and that each bf the loops 102*a*, 102*b*, 102*c*, 102*d* and 102*e* closely faces its one side portion of the longitudinal direction to the opening 100*a* and is sectorially arranged with one side portions thereof are concentrated in the vicinity of the opening and the other side portions thereof are separately disposed in an approximately same distance within the region of ±45 degrees for a total separating angle.

According to the automobile antenna device in accordance with the embodiment, therefore, when the automobile antenna device is attached with the opening 100*a* to face to the end portion of the metal plate 105 in order to detect the surface current of the automobile body induced in the metal plate 105 of the body by the broadcasted waves, one loop at least among the loops 102*a* through 102*e* can be positioned at the best detective angle for the surface current, that is, 45 through 90 degrees or −45 through −90 degrees, as is shown in FIG. 6, and the surface current can be detected with high efficiency, despite the electrostatic shield case is attached at any angle.

Furthermore, according to the loop antenna 102 formed by winding the antenna line into five loops, the output voltage can be theoretically obtained by five times higher than the one with the one time wound. As the respective loops are sectorially arranged, the incidental capacity arisen between the respective loops is extremely small in comparison with the simple dense winding, and movement of the resonant frequency as is of practical problem and decrease of acuteness (Q) and sensitivity caused from the movement are not occurred.

In FIG. 2 it is also preferable that the metal plate 105 of the automobile body can be inserted and arranged into the opening 100*a* to have the distance between the loop antenna 102 and the metal plate 105 to be as short as possible.

Consequently, the detective efficiency of the surface current is more increased.

The surface current detected as mentioned above is input to a circuit 106 built in the case 100 by way of output ends 102*f* and 102*g* of the loop antenna to be matched and amplified therein. Furthermore, the detected signal obtained in such a way is taken outside by a coaxial wire, not illustrated, by way of a connector 108 to be supplied to the various receivers through voltage amplifiers, etc.

Incidentally, the power source and the signal are connected and supplied to control the circuit 106 through a control signal wire 110.

As described hereinabove, according to the automobile antenna device in accordance with the teachings of the present invention, receiving action of the broadcasted waves can be obtained with extremely high efficiency and reliability without any restriction of installing angles, etc. and without externally exposing the automobile antenna device, which electromagnetically detects the surface current flowing through the metal plate of the automobile body.

Furthermore, in the present invention, the automobile antenna device can be installed at any place of the metal plate of the automobile body where the surface current can be produced by the broadcasted waves, that is, roof rim bar, engine room hood, trunk lid, etc.

It is preferable that the automobile antenna device is installed at the rim surrounding area of the automobile body and the marginal portion of metal material where the surface current flows strongly.

As described heretofore, according to the present invention, the surface current being induced by the broadcasted waves and flowing in the metal plate of the automobile body can be efficiently detected by the loop antenna composed of a plurality of loops formed by the wound antenna wires and the respective loops sectorially arranged with their opening sides as a center without affection of installing angles, and there is no need of pole antenna externally exposed as was in the prior art device, and further, the automobile antenna device can be easily obtained with small sizes and good capability.

What is claimed is:

1. An automobile antenna device comprising:

an electrostatic shield case having an opening to face to a metal plate of the automobile body; and a loop antenna being internally arranged in said electrostatic shield case so that said loop antenna can be facingly provided to said opening in its close vicinity, in order to detect the surface current induced in the surface of the automobile body by broadcasted waves, wherein said loop antenna is equipped with a plurality of loops which are respectively formed by wound antenna wires, and said respective loops are sectorially arranged with one side portions thereof are concentrated in the vicinity of the opening and the other side portions thereof are separately disposed in an approximately same distance.

2. An automobile antenna device according to claim (1), wherein each of said loops faces one side of its longitudinal sides to said opening in its close vicinity and is sectorially arranged at an angle within ±45 degrees with the opening side as a center.

3. An automobile antenna device according to claim (1), wherein said opening of said electrostatic shield case is formed so that a metal plate end of the automobile body can be inserted therein.

4. An automobile antenna device according to claim (1), wherein said loop antenna consists of five loops which antenna wires are wound around and the respective loops are sectorially arranged.

5. An automobile antenna device according to claim (1), wherein said loop antenna is closely arranged to face to the margin portion of roof rim bar.

6. An automobile antenna device according to claim (1), wherein said loop antenna is closely arranged to face to the margin portion of engine room hood.

7. An automobile antenna device according to claim (1), wherein said loop antenna is closely arranged to face to the margin portion of trunk lid.

* * * * *